US007000637B1

(12) United States Patent
Kjaer

(10) Patent No.: US 7,000,637 B1
(45) Date of Patent: Feb. 21, 2006

(54) HOT WATER ONLY-ON-REQUEST FAUCET SYSTEM

(76) Inventor: Jens Kjaer, 1812 Michigan Blvd., Racine, WI (US) 53402

( * ) Notice: Subject to any disclaimer, the term of this patent is extended or adjusted under 35 U.S.C. 154(b) by 20 days.

(21) Appl. No.: 10/835,950

(22) Filed: Apr. 30, 2004

(51) Int. Cl.
*F16K 11/00* (2006.01)

(52) U.S. Cl. ..... 137/801; 4/677

(58) Field of Classification Search ..... 137/1, 137/605, 801; 4/677
See application file for complete search history.

(56) References Cited

U.S. PATENT DOCUMENTS 4,077,545 A 3/1978 Karls
4,709,728 A 12/1987 Ying-Chung
4,738,280 A 4/1988 Oberholtzer
5,323,803 A 6/1994 Blumenauer
5,551,630 A 9/1996 Enoki et al.
5,606,987 A 3/1997 Weber
6,019,130 A 2/2000 Rump
6,109,288 A 8/2000 Al-Hamian

*Primary Examiner*—John Fox
(74) *Attorney, Agent, or Firm*—Boyle Fredrickson Newholm Stein & Gratz S.C.

(57) ABSTRACT

A modified single-handled faucet is configured to permit the faucet to dispense hot water only if the operator actuates a hot water demand switch. The control valve couples the outlet of the faucet to the cold water source unless the operator actuates the hot water demand switch, and thereafter permits water to be dispensed from the hot water source, preferably via a conventional mixing valve that mixes hot and cold water in a desired proportion prior to dispensing the mixed stream.

21 Claims, 4 Drawing Sheets

HOT WATER ONLY-ON-REQUEST FAUCET SYSTEM

FIELD OF THE INVENTION

The present invention relates to faucet systems, and more specifically to a faucet system designed to allow only cold water flow unless hot water flow is specifically requested.

BACKGROUND OF THE INVENTION

Faucets having a single handle for adjusting both water flow rate and water temperature are well known. In such faucets, the handle is lifted upward to adjust water flow, and is moved from side to side to adjust hot and cold water proportions such that a desired overall temperature is achieved. Generally, the handle has approximately 180 degrees of freedom, such that only cold water from a cold water source is dispensed when the handle is at its rightmost position, and only hot water from a hot water source is dispensed when the handle is at its leftmost position. When the handle is located between these two extreme positions, a mixture of hot and cold water is dispensed.

One problem with this type of single-handle faucet is that at least some water is drawn from the hot water source in every operative position of the faucet handle except the extreme right. As a result, even though the operator may require only cold water, if he or she lifts the handle without first moving it to the extreme right, or neglects to move the handle to the right after lifting, at least some hot water from the hot water source will be used. The amount of hot water wasted in a given water drawing incident will be directly proportional to the handle position and the duration of time the handle is not turned to the extreme right. The cumulative effect of multiple incidents of this type, as may occur, for example, when the operator is running a garbage disposal or rinsing dishes while loading a dish washer can be a substantial waste of energy.

Also, if drinking water is being drawn and the faucet handle is in any position other then the extreme right, at least some hot water will be drawn and consumed. This water may not be safe for consumption since it may have been stagnant in a sediment laden tank for a substantial amount of time.

The need has therefore arisen for a single handled faucet that draws water from a hot water source only if an operator specifically requests hot water and then functions as a conventional single handle faucet for the duration of use.

SUMMARY OF THE INVENTION

In order to prevent energy wastage associated with the inadvertent drawing of water from a hot water source in a faucet system, the present invention is directed to a system and method for dispensing only cold water from an outlet unless the operator performs an act that clearly indicates a conscious desire to draw hot water. The invention is additionally directed to methods of installing and using such a system.

The system comprises a faucet having a single handle, a hot water inlet, a cold water inlet, an outlet such as a spigot, and a mixing valve that is responsive to handle motion to control the flow rate of water out of the outlet and the proportion of hot and cold water dispensed from the outlet. Water flow to the hot water inlet of the mixing valve is controlled by a control valve coupled to both the hot water conduit and the cold water conduit. The control valve supplies cold water to the hot water inlet of the mixing valve unless the operator activates a switch or takes some other action clearly commanding hot water.

This design effectively reverses the role of the operator from consciously turning off hot water by moving the handle to consciously selecting hot water when actually desired.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION

Construction of First Embodiment

Figure 1:
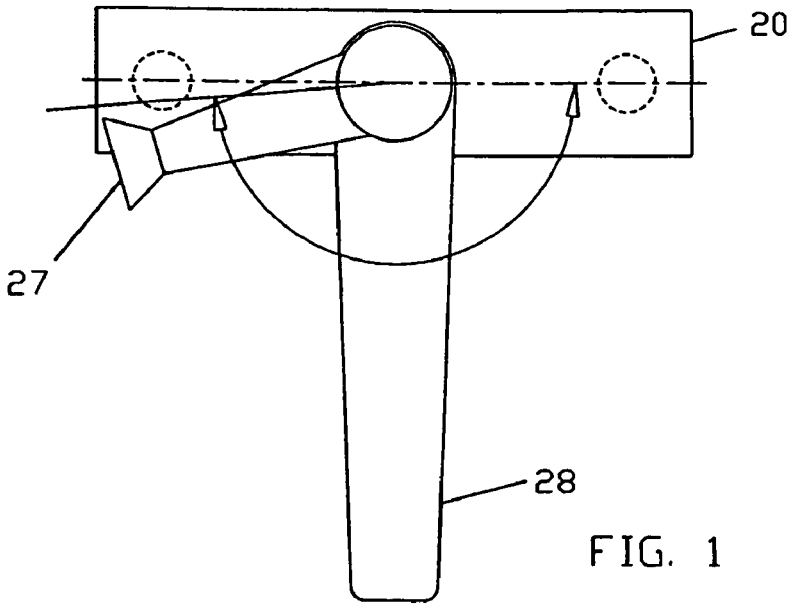
FIG. 1 is a top plan view of a faucet system constructed in accordance with a first embodiment of the invention.
Figure 2:
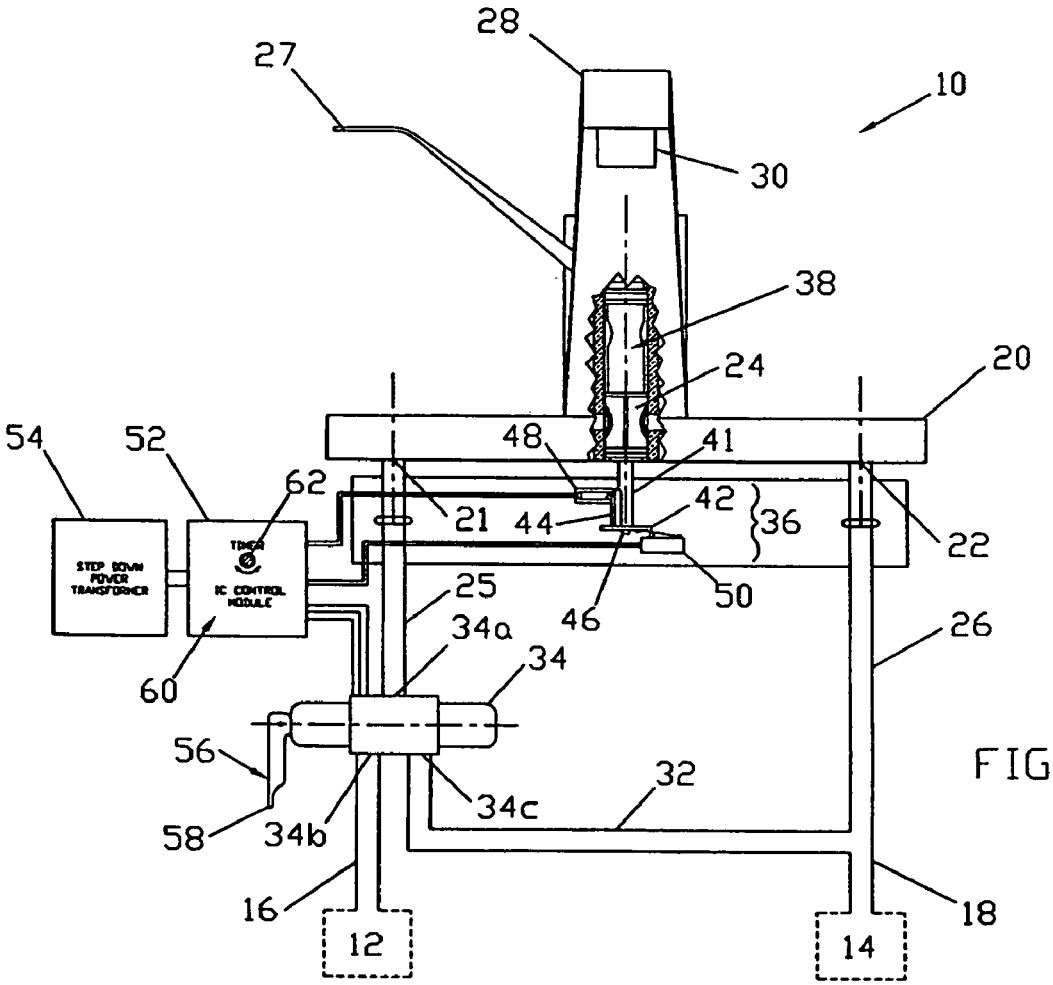
FIG. 2 is a partially cut away front elevation view of the faucet system of FIG. 1.

Referring to FIGS. 1 and 2, a faucet system 10 constructed in accordance with a first preferred embodiment of the invention is coupled to a hot water source 12 and a cold water source 14 by conduits 16, 18. The faucet system 10 includes a base 20, a handle 27 mounted on top of the base 20, and hot and cold water inlets 21 and 22 formed in the bottom of the base 20. The inlets 21 and 22 are connected to a modified standard mixing valve 24 by internal passages or conduits (not shown). The inlets 21 and 22 are also supplied with water from standard lines 25 and 26.

Mixing valve 24 is actuated by the handle 27 to allow a mixture of hot and cold water from inlets 21 and 22, through spigot 28, and to a common outlet 30. Handle 27 has approximately 180 degrees of freedom, allowing a wide range of hot and cold water mixtures. At the extreme ends of the range of motion of handle 27 are "hot only" and "cold only" positions. The flow rate of water through the faucet system 10 can be varied from 0 (off) to maximum by raising the handle 27 from its lower most position to its uppermost position. All of the structures as thus far described are conventional.

Figure 3:
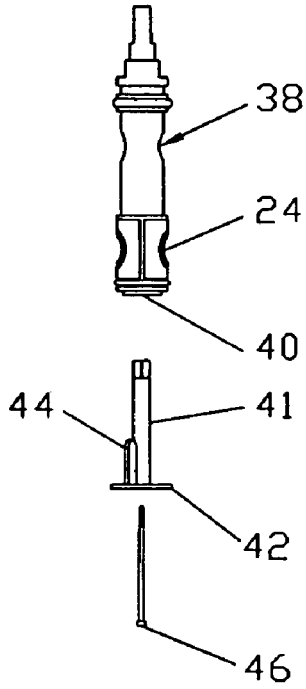
FIG. 3 is an exploded view of a mixing valve cartridge assembly and control plate of the faucet system of FIGS. 1 and 2.

In the present invention, system 10 is modified to include a cold water bypass 32, a control valve 34, and a switch assembly 36 for actuating control valve 34. Referring now to FIG. 2, the control valve 34 of the first embodiment comprises a three way, two position solenoid valve having a single outlet 34*a* connected to the waterline 25 and first and second inlets 34*b*, 34*c* connected to the hot water supply conduit 16 and a cold water bypass line 32, respectively. The control valve 34 is normally maintained in an "energy saving" position in which the valve outlet 34*a* is connected to the second valve inlet 34*c* cold water is isolated from the first valve inlet 34*b*, hence preventing hot water from flowing from source 12 to hot water inlet 21. The control valve 34 is selectively switchable to a "hot water supply" position in which the valve outlet 34*a* is connected to the conduit 16 and is isolated from the cold water bypass passage line 32, hence permitting hot water to flow from the source 12 to the hot water inlet 21. The control valve 34 is responsive to a switch which is actuated when the operator takes positive action to demand hot water. For instance, the switch could be actuated by a push button located on the handle 27, the base 20, or even an area adjacent the faucet such as on the countertop or sink. In the present embodiment, a switch assembly 36 is incorporated into the faucet system 10 and is responsive to movement of the handle 27. It is preferably responsive to movement of the mixing valve 24. Mixing valve 24, as best seen in FIG. 3, is part of a standard faucet cartridge assembly 38, in this case a cartridge assembly manufactured by Moen®. Assembly 38 is modified such that a bore 40 is drilled into its bottom to receive a post 41 bearing a switch control plate 42. Switch control plate 42 bears a projection 44. Control plate 42 is held in place within bore 40 via screw 46, and control plate 42 rotates left to right and moves up and down along with the motion of an internal stem of cartridge assembly 38 as driven by handle 27.

Figure 4:
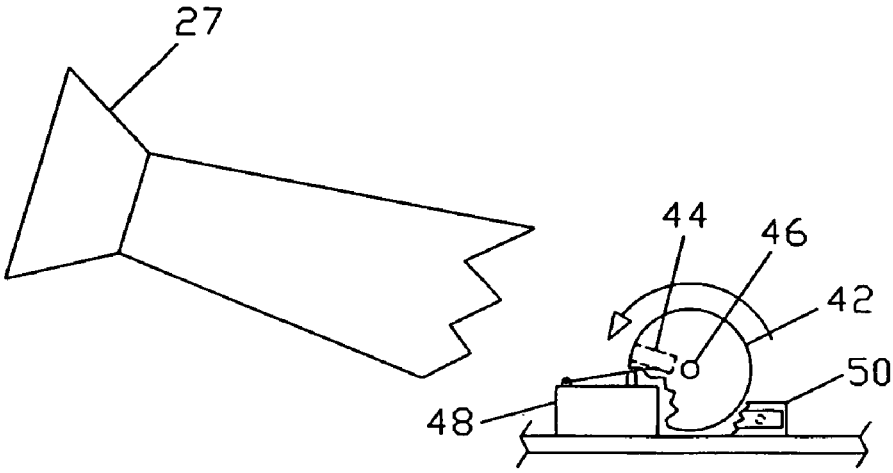
FIG. 4 is a cutaway top view of the control plate and switches.

Referring again to FIG. 2, switch assembly 36 additionally includes a "hot water demand" switch 48 and a "return to energy savings" switch 50. Each of these switches may, for example, be a proximity switch, though contact switches are shown in the drawings. As seen in FIG. 4, in the preferred embodiment, hot water demand switch 48 is located adjacent control plate 42 approximately 5 degrees forward from a rotational position of the cartridge assembly 38 corresponding to the "hot only" position of handle 27. Hot water demand switch 48 is actuated by turning handle 27 almost all the way to its "hot request" position, at which point projection 44 contacts and activates switch 48. The "return to energy savings switch" 50 is located adjacent control plate 42 just beneath plate 42 such that return switch 50 is actuated when control plate 42 is in its lowest position, i.e. when handle 27 has been depressed to turn off the faucet.

Switches 48 and 50 are both electronically coupled to a control module 52, which is powered by a power transformer 54. Power transformer 54 is supplied with household current in the conventional manner. As is typical of such modules, transformer 54 steps down the input AC voltage to reduced DC voltage and delivers the reduced DC voltage to control module 52. The control module 52 preferably comprises a conventional integrated circuit (IC) control mode.

Figure 5:
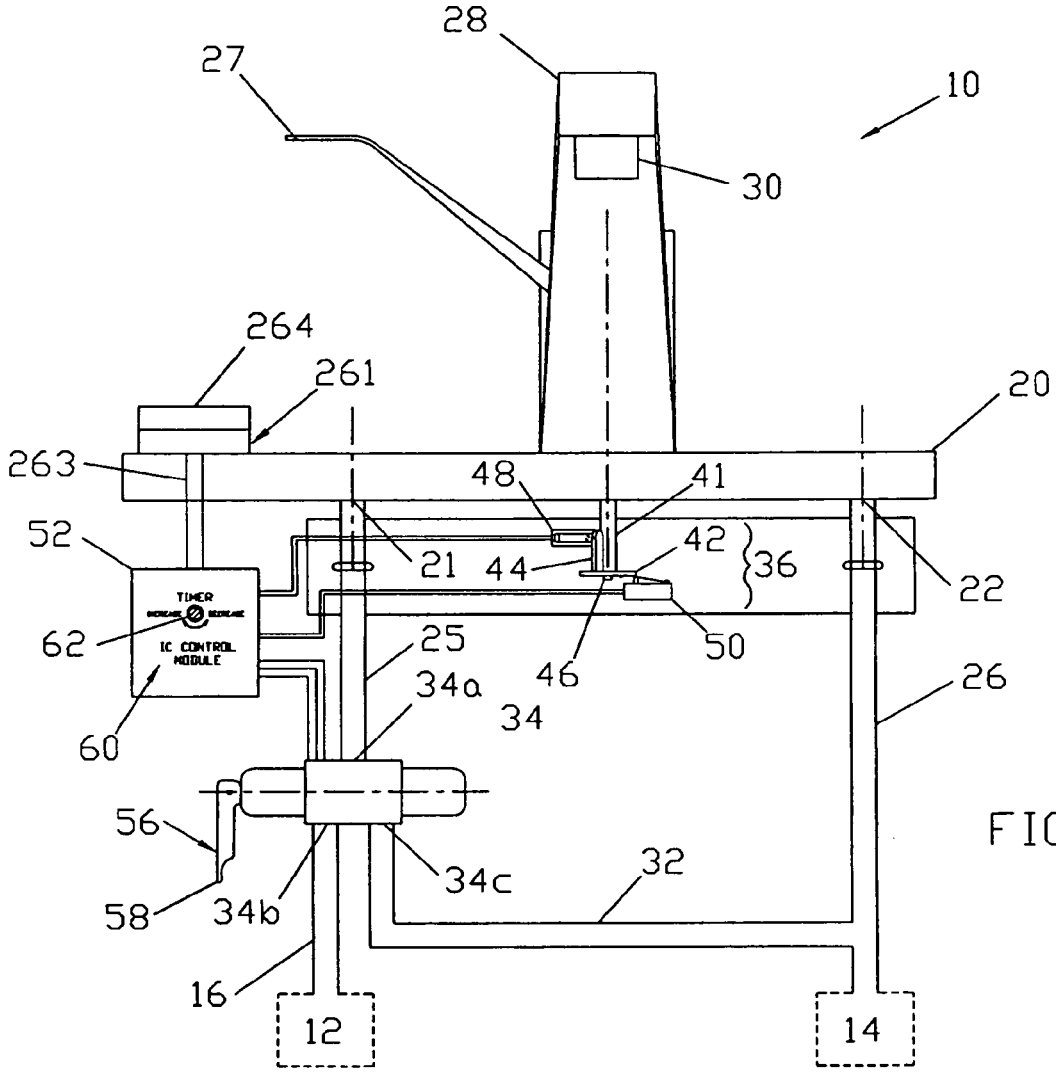
FIG. 5 is a front elevation view of the faucet system of FIG. 1, illustrating an alternative power source.

Alternatively, the transformer 54 could be replaced by a self-contained DC power source. One such source is illustrated in FIG. 5 in the form of a battery pack 261. Battery pack 261 is connected directly to the control module 52 and provides the power for actuating valve 34. Battery pack 261 can be attached through a bore 263 in base 20 so that it is readily accessible when a battery (not shown) needs to be changed, and is provided with a cover 264. Cover 264 preferably matches the rest of the external components of the faucet system 10.

Referring again to FIG. 2, module 52 in turn actuates control valve 34, which in the present embodiment is a solenoid valve, thereby allowing hot water to flow into hot water inlet 21 and closing off access to cold water bypass 32. Once demand switch 48 has been activated, hot water from source 12 is allowed to flow through inlet 21 for as long as the user keeps lever handle 27 raised, regardless of the position of handle 27.

An additional feature of control valve 34 is a manual override 56 for allowing water to be drawn from hot water source 12 in the event of an electrical outage or failure of the control module 52. In the present embodiment, override 56 comprises a lever 58 that can be actuated to manually drive the control valve 34 to its hot water supply position.

Advantageously, the preferred embodiment also includes a timer feature that negates the need to repeatedly move the handle 27 to its leftmost position during periods of frequent use, as is often the case when a person is washing dishes. It is therefore desirable to allow an operator to draw hot water from faucet system 10 multiple times without having to make multiple specific hot water demands. A system which did not allow multiple draws of hot water in a single episode could become cumbersome and irritating, thus encouraging the user to manually override the system on a permanent basis and preventing the energy savings associated with use of the system.

In this embodiment, a timer 60 is interposed between return switch 50 and valve 34, and preferably on the control module 52. The timer 60 of this embodiment consists of a potentiometer (not shown) that is positioned in the control module 52 and that is responsive to closure of the switch 50 to enable switching of the control valve 34 from its hot water dispensing mode to its energy savings mode after a designated period of time. The designated time may be adjusted by turning a dial or screw 62 on the side of the control module 52 (seen schematically as 62 in FIG. 2). The currently preferred embodiment of the timer 60 has a minimum of 2 minutes and a maximum of 5 minutes. During the set time period, any lift of handle 27 between the two extreme ends of the handle's range will draw both hot and cold water. The timer 60 will reset when the handle 27 is pushed down to close switch 50, again preventing the control valve 34 from closing. As a result, the control valve 34 switches into its energy savings position only if the faucet is turned off and left in its off position for at least the designated period.

In normal use of system 10, if an operator merely lifts handle 27 to obtain water without specifically requesting hot water, only cold water from cold water source 14 will be dispensed. In order to draw hot water, the operator turns handle 27 to the far left to activate the hot water demand switch 48, and both hot and cold water from sources 12, 14 are provided as desired. The operator then adjusts the flow and temperature of the water as desired using handle 27 to control mixing valve 24 in the conventional manner.

When the operator no longer requires water, he or she lowers handle 27 to shut off the water, which has the additional effect of beginning a pre-set time period. If the operator does not lift handle 27 again within the pre-set time, the system 10 will reset to again provide only cold water when handle 27 is lifted. However, if the operator lifts handle 27 again before the pre-set time period expires, both hot and cold water from sources 12, 14 continue to be dispensed.

Construction of Second Embodiment

Figure 6:
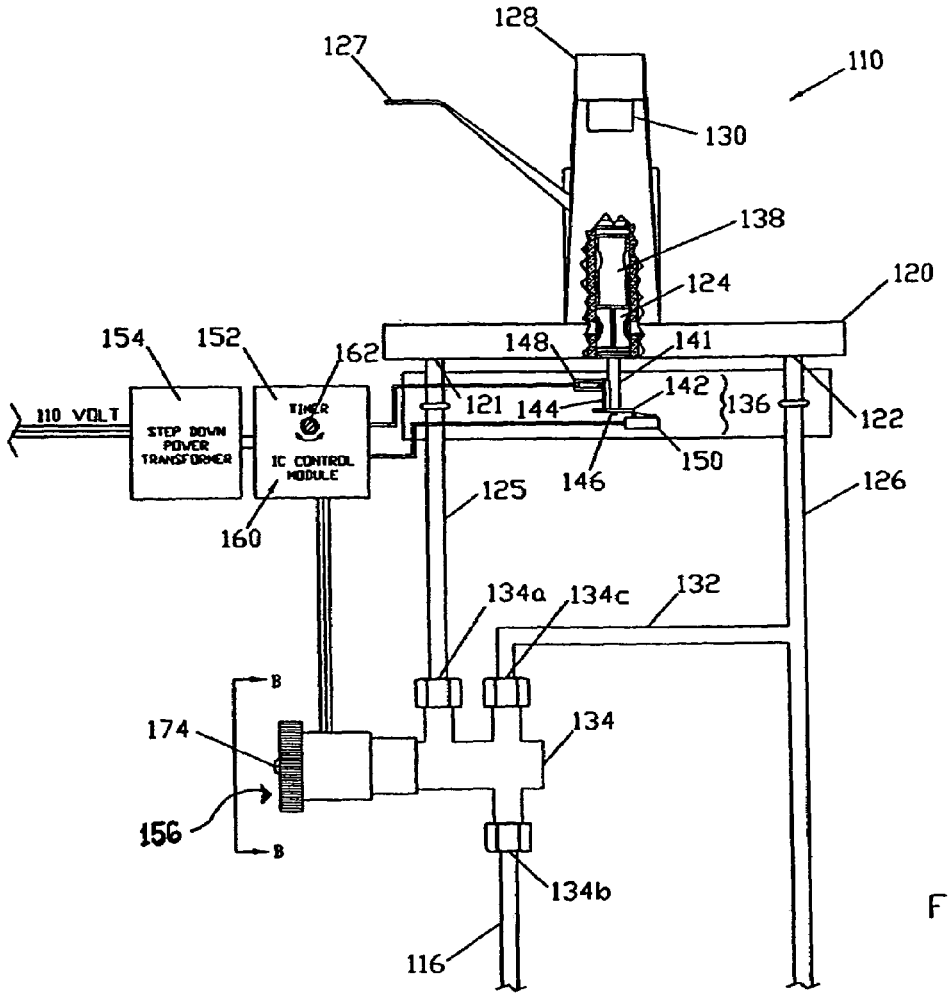
FIG. 6 is a partially cut away front elevation view of a faucet system constructed in accordance with a second embodiment of the invention.
Figure 7:
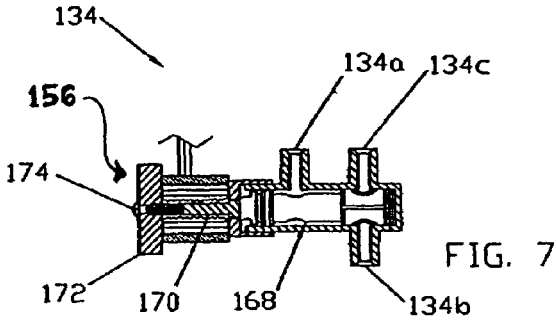
FIG. 7 is a cutaway side elevation view of the control valve of the faucet system of FIG. 6.
Figure 8:
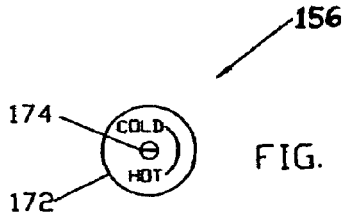
FIG. 8 is a view of the knob of the control valve taken along lines B—B in FIG. 6.

A second embodiment of the invention, shown in FIGS. 6–8, is similar in most respects to the first embodiment. The reference numerals shown are the same as for the first embodiment, incremented by 100, where corresponding parts are found.

As in the previous embodiment, a hot water demand switch 148 and a return to energy savings mode switch 150 are located adjacent to a control plate 142 and projection 144 borne by a modified cartridge assembly 138. In this way, handle 127 of system 110 is able to effect switching of the control valve 134 between the hot water supply mode and energy savings mode.

However, in this embodiment, control valve 134 is not a solenoid valve. Referring to FIG. 7, it can be seen that valve 134 instead contains a cartridge 168 similar to the cartridge 138 containing mixing valve 124. In order to use cartridge 168 effectively in valve 134, hot water conduit 116 and cold water bypass 132 are arranged so that they connect with valve 134 opposite one another, as shown in FIGS. 6 and 7. A motor 170, controlled by the control module 152, turns the cartridge 168 within valve 134 all the way clockwise to allow hot water to be released through line 125, or all the way counter-clockwise to prevent hot water from being disposed and to allow only cold water to flow through the valve 134 from bypass 132. Hence, the valve 134 functions as a three-way, two position valve rather than a mixing valve.

System 110 also includes a manual override feature 156, but in the present embodiment, override 156 consists of a knob 172 connected to the outer axial end of the cartridge assembly 168 by a screw 174. In order to override system 110, knob 172 is manually turned all the way clockwise to connect valve 134 to hot water conduit 116 and disconnect it from cold water bypass 132.

Valve 134 of the present embodiment is also of somewhat simpler and of more durable construction than the solenoid version. The faucet system 110 of this embodiment is otherwise identical in construction and operation to the faucet system 10 of the first embodiment.

While the present invention has been described and illustrated in connection with preferred embodiments, the scope is not to be limited by such description and illustration, but is to be limited solely by the scope of the claims, which follow. It should be noted that features of the various embodiments may be combined and suitable equivalents may be substituted without departing from the scope of the present invention.

I claim:

1. A system for dispensing only cold water unless hot water is desired, comprising:

a faucet having a handle and a water outlet;

a first, mixing valve that is actuated by the handle and that is configured to regulate the amount of hot and cold water dispensed at the outlet, the mixing valve having a hot water inlet, and a cold water inlet in fluid communication with the faucet outlet;

a hot water conduit in fluid communication with the hot water inlet of the mixing valve;

a cold water conduit in fluid communication with the cold water inlet of the mixing valve;

a second, control valve disposed between the hot water conduit and the hot water inlet, the control valve having a hot water inlet, a cold water inlet, and an outlet in fluid connection with the hot water inlet of the mixing valve; and a cold water bypass leading from the cold water conduit to the cold water inlet of the control valve.

2. The system of claim 1, wherein the control valve is a solenoid valve.

3. The system of claim 1, wherein the control valve is a mixing valve.

4. The system of claim 1, wherein the control valve can be manually set in a position in which hot water is always available.

5. The system of claim 1, further comprising a hot water demand switch and a controller that is responsive to the operation of hot water demand switch to actuate the control valve to connect the hot water inlet of the control valve to the outlet of the control valve.

6. The system of claim 5, further comprising a return to energy savings switch that is responsive to faucet shut-off to connect the cold water inlet of the control valve to the outlet of the control valve.

7. The system of claim 5, wherein the hot water demand switch is actuated when the handle is manipulated to a position demanding the dispensation of at least essentially only hot water from the faucet system.

8. The system of claim 5, further comprising a power source connected to the controller.

9. The system of claim 8, wherein the power source is a source of household current.

10. The system of claim 8, wherein the power source comprises at least one battery.

11. The system of claim 6, further comprising a timer that is responsive to the return to energy savings switch to disable switching of the control valve to the return to a position connecting the cold water inlet of the control valve to the outlet of the control valve for a designated period of time after the return to energy savings switch is activated.

12. A system for dispensing only cold water unless hot water is desired, comprising:

a faucet having a handle and a water outlet;

a first, mixing valve that is actuated by the handle to regulate the amount of hot and cold water dispensed at the outlet, the mixing valve having a hot water inlet and cold water inlet in fluid communication with the mixing valve;

a hot water conduit in fluid communication with the hot water inlet of the mixing valve;

a cold water conduit in fluid communication with the cold water inlet of the mixing valve;

a second, control valve disposed between the hot water conduit and the hot water inlet, wherein the control valve has a first, energy savings position, which prevents water from the hot water conduit from entering the hot water inlet, and a second, hot water position, which allows water from the hot water conduit to enter the hot water inlet;

a cold water bypass leading from the cold water conduit to the control valve; and a switch assembly disposed between the mixing valve and the control valve, wherein the switch assembly is actuated by movement of the handle.

13. The system of claim 12, wherein in the first, energy savings position of the control valve, only cold water from the cold water bypass is allowed into the hot water inlet, and in the second, hot water position, cold water from the cold water bypass is prevented from entering the hot water inlet.

14. The system of claim 12, wherein the switch assembly comprises at least one switch, a device for actuating the at least one switch, a controller, and a power source.

15. The system of claim 14, wherein the device for actuating the at least one switch is connected with the mixing valve such that it moves in relation to the movement of the handle.

16. The system of claim 15, wherein the at least one switch is actuated when the device for actuating is rotated to a predetermined position by movement of the handle to the predetermined position.

17. The system of claim 12, further comprising a manual override device connected with the control valve.

18. A method of dispensing hot water from an outlet comprising:

manipulating a handle of a single-handled faucet to dispense water, the handle being movable through a range to produce a desired mixture of hot water and cold water;

dispensing only cold water through at least a majority of the range of handle motion; then activating a hot water demand switch; and then dispensing hot water through at least the majority of the range of handle motions.

19. The method of claim 18, further comprising manipulating the handle to shut off water flow, then manipulating the handle to initiate water flow again within a predetermined time period and dispensing hot water without having to actuate the hot water demand switch.

20. The method of claim 18, wherein the step of actuating the hot water demand switch comprises moving the handle to a position demanding only hot water.

21. A method of installing an energy saving faucet arrangement comprising:

modifying the mixing valve of a single-handled faucet outlet to attach at least one switch actuator;

installing at least one switch adjacent to the at least one switch actuator;

installing an electrically powered control valve in a hot water line;

installing a bypass conduit in a cold water line;

connecting a bypass conduit to a control valve; and electrically connecting the control valve and at least one switch to a controller.

* * * * *